US005114113A

United States Patent [19]

Krinner

[11] Patent Number: 5,114,113

[45] Date of Patent: May 19, 1992

[54] CHRISTMAS TREE STAND

[76] Inventor: Klaus Krinner, Blumenthal, Fed. Rep. of Germany

[21] Appl. No.: 589,069

[22] Filed: Sep. 27, 1990

[30] Foreign Application Priority Data

Sep. 28, 1989 [DE] Fed. Rep. of Germany ..... 3932473

[51] Int. Cl.[5] ..... F16M 13/00

[52] U.S. Cl. ..... 248/525; 47/40.5

[58] Field of Search ..... 248/524, 525, 526, 519, 248/523; 47/40.5

[56] References Cited

U.S. PATENT DOCUMENTS

| | | | |
|---|---|---|---|
| 1,546,314 | 7/1925 | Prince | 248/524 |
| 2,023,340 | 12/1935 | Peskulich . | |
| 2,260,932 | 10/1941 | Chulick | 248/524 |
| 2,455,025 | 11/1948 | Schroeder | 248/526 X |
| 2,522,156 | 9/1950 | Balmer | 47/40.5 |
| 2,909,344 | 10/1959 | Dutton | 47/40.5 |
| 3,231,226 | 1/1966 | Rossler | 248/524 X |
| 3,301,512 | 1/1967 | Nyberg | 248/524 |
| 4,130,965 | 12/1978 | Patton | 47/40.5 |
| 4,936,538 | 6/1990 | Royce | 47/40.5 X |

FOREIGN PATENT DOCUMENTS

| | | | |
|---|---|---|---|
| 2156712 | 11/1971 | Fed. Rep. of Germany | 248/524 |
| 7204742 | 2/1972 | Fed. Rep. of Germany . | |
| 2358151 | 8/1977 | Fed. Rep. of Germany . | |
| 2352282 | 12/1977 | Fed. Rep. of Germany . | |

*Primary Examiner*—J. Franklin Foss
*Attorney, Agent, or Firm*—Omri M. Behr

[57] ABSTRACT

A Christmas-tree stand (2) features a foot-piece (4) with a connected holder (6) to which fastening components (14, 16, 18 and 20) are attached. In the example case, these components are swinging clamps which are pressed against the outer surface of the tree trunk by a clamping device (46). The pressure of the clamping device (46) is applied to the fastening components (14, 16, 18 and 20) via a steel cable (66), for example, which encircles them and is attached to the clamping device (46). The cable (66) moves the fastening components (14, 16, 18 and 20) toward the trunk with adjustable and evenly distributed force.

16 Claims, 3 Drawing Sheets

CHRISTMAS TREE STAND

Figure 1:
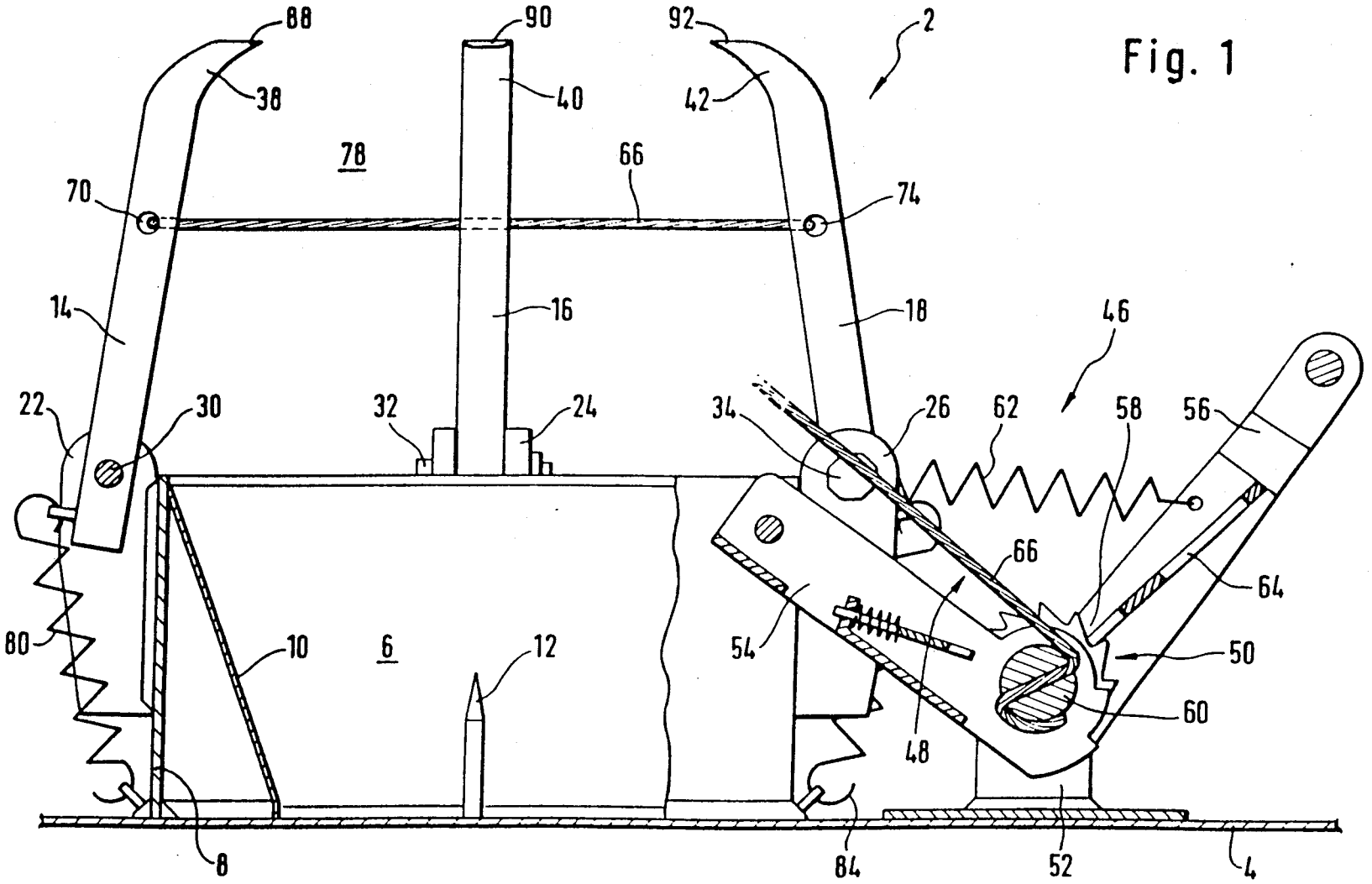

The invention consists of a Christmas-tree stand as described in the preamble of claim 1.

In the familiar type of Christmas-tree stand, a sheath is affixed vertically to plate or a foot-piece and serves to hold the bottom end of the tree trunk. Clamp screws are provided at regular spacing around the side of the sheath, which point into the holder and serve to wedge in and thereby hold up the trunk. The disadvantage of this design is the fact that only a very small gripping force can be applied to the trunk be means of the clamp screws, which are usually tightened by hand. Therefore these familiar Christmas-tree stands do not do their jobs satisfactorily. Furthermore, the exact vertical positioning of the tree that is desirable for aesthetic reasons is difficult to accomplish. Finally, positioning and clamping requires the assistance of a second person, as simultaneously holding the tree and tightening the clamp screws is practically impossible.

Another well-known method is to fasten the tree trunk into a suitably large hole drilled in a foot-piece by means of wooden wedges.

DE-AS 23 52 892 shows a stand specifically intended for setting up Christmas-trees with a trunk sheath attached vertically to a ground plate in familiar fashion. Within this sheath, a second, sliding sheath is inserted which rests its bottom on a tension spring of corresponding proportions. This inner coaxially mobile sheath serves to receive the tree trunk. Clamps are fixed along the upper edge of the outer sheath that can swing out towards the center axis of the two sheaths. To fasten a Christmas-tree trunk in this familiar type of stand, the bottom end of the trunk is introduced into the inner coaxially mobile sheath, and then both are moved downwards in the outer sheath against the force of the spring. This gravity-assisted motion of trunk and sheath allows the clamps on the outer sheath to swing inward, where they come into contact with the outer surface of the tree trunk and center it. The disadvantage of this design that it only operates correctly in a certain range of trunk diameters. Above that range, any substantial departure of the trunk's cross-section from a perfect circle makes holding the trunk vertically and centering it without trouble virtually impossible.

DE-PS 25 47 184 shows a tree stand, in which the trunk is inserted into a slotted sheath. A wedge-shaped jam, much like a screw cap, is then screwed on to the outside of the sheath. By means of its wedge shape it forces radially arranged pressure pads toward the tree trunk, which then jam against the trunk in the sheath and fasten it in place. This well-known tree stand also has the disadvantage that a substantial departure of the trunk's cross-section from a perfect circle causes the pressure pads to fit unevenly, thereby giving it an insufficient grip as well as making the tree position deviate from the vertical.

DE-OS 30 03 233 as well as U.S. Pat. No. 2,260,932 show a device for vertically fastening pole-shaped objects, especially tree trunks, in which the trunk is anchored and fastened in a mount by means of a complicated system of guy-wires in the manner of a ship's mast. Aside from the fact that the guy-wires span over a considerable portion of the height of the tree, these familiar devices are of extremely complicated construction and, in addition, are inconvenient to use.

DE-PS 20 42 shows a Christmas-tree stand consisting of a cylinder equipped with openings running straight up and down and mounted vertically on a foot-piece or stand. Clamps are inserted into the slot-shaped gaps hinging on horizontal axes of rotation which allow them to pivot. The upper end of the clamps tapers to a sharp-edged point, while the bottom ends are blunt and project inside the cylinder in the resting position. When the tree trunk is inserted into the cylinder, this downward motion brings its bottom end into contact with the ends of the clamps projecting inward. The clamps pivot on the horizontal axes, and the ends with the sharp-edged points are pressed into the cylinder where they dig into the wood of the trunk. They are supposed to hold the tree this way. The disadvantage of this design is that the force needed to hold the tree must be exerted in the motion of inserting the trunk into the holder. This means that increasing resistance must be overcome as the trunk is inserted further into the mount, which finally become so great as to prevent further insertion of the trunk even before the edges or claws of the clamps can provide sufficiently secure lateral stability.

DE-OS 23 581 51 introduced a type of Christmas-tree stand consisting in essence of a holder for the bottom end of the tree trunk from which extendable legs spread out radially. The holder has three clamp arms or support claws, for example, which can be moved toward or away from the trunk surface by means of a connecting clamping device and an intermediate toggle-lever joint. By operating the clamping device, a clamp screw in the practical example, a horizontal plate is moved up and down, and toggle-lever joints attached to the plate transfer this motion to the individual clamp arms. As with the other tree stands of prior art mentioned, a Christmas-tree stand according to DE-OS 23 58 151 has the disadvantage that the simultaneous guided motion of the clamp arms makes it very difficult to mount non-circular tree trunks exactly vertically. Objects falling under DE OS 23 58 151 therefore, use adjusting screws on the outside radial ends of the support legs for the exact vertical positioning of the mounted tree trunk. This allows one to accommodate for the unevenness of the floor and to get the tree straight, or to compensate for clamping the tree in crookedly and be able to set the tree up in a vertical position.

By contrast, the purpose of the following invention is to equip a Christmas-tree stand so that irregularly-contoured tree trunks can be fastened and held securely and reliably in a vertical position with adjustable force.

This task is accomplished in the present invention by by means of a stand comprising one foot-piece; a holder for the trunk of the tree attached to the foot-piece; a plurality of fastening components having a butt end and a pivotal end arranged symmetrically around a central axis, said components being swingable about a pivot axis proximal to said pivotal end between and open and a fastening position in planes approximately intersecting at the axis of symmetry, wherein the butt-ends of the fastening components are pressable against the trunk of the tree; and a single clamping device acting on all fastening components simultaneously via a power transmission component, thus moving them into their fastening position with adjustable gripping force. The fastening components are applicable to the trunk by said power transmission component basically without force and independently of each other, so that the gripping force does not act on the trunk until all fastening components have made contact with the said trunk.

The power transmission component of the invention, with which the individual fastening components can be moved, applies these fastening components to the trunk of the tree without substantial force and independently of each other. The actual gripping force is not exerted until all the fastening components have then been applied to the trunk. Since the power transmission component thus acts simultaneously and with similar force on all fastening components, this assures that the chosen position of the trunk is not changed as the fastening force is increased, because the opposing forces cancel each other out at all times, regardless of the contours of the trunk. The fastening components that is first applied to the surface of the trunk does not exert any force upon it until the other ones are also applied, either all at once on one after the other. Thus virtually no force is transmitted to the trunk until all fastening components are touching it, so that its position cannot change once it has been chosen. On subsequently operating the clamping device, force is applied to the fastening components via the power transmission component in such a way that they cancel each other out, the result being that no force is generated that could press the tree out of its position. This has the advantage of insuring that the Christmas-tree keeps its chosen position and is securely fastened there by the bare end of its trunk.

The invention also comprises further useful embodiments. The pivoting axles of the fastening components may be arranged on the same level, and have the advantage of effecting a regular application of the fastening components to the surface of the trunk wherein said fastening components are swingable on pivot axles which all lie in the same plane, perpendicular to the axis of symmetry.

Considerable adjustable force may be exerted on the surface of the bare end of the tree by means of simple constructions. The power transmission component is applicable upon each fastening component in an area between the butt-ends and the pivot axle. It may be made of a tensile and flexible material, preferably steel cable. The clamping device may be a locking ratchet mechanism.

Great force may be exerted to and reliably fasten the trunks of even comparably large trees where the power transmission component is a pressure line having pressure cylinder attachable thereto which act upon the fastening component and the clamping device is a pressure pump. These measures are especially useful for unusually small-scale constructions.

A further embodiment wherein the pressure cylinders are attached to the fastening components in an area on the side of the pivot axles distal from the butt-ends, allows the employment of pressure-cylinders, while above all retaining the radial compactness of the construction.

By fashioning the free ends of the fastening components in a claw shape, so that they can claw into the trunk with increasing gripping force, a very dependable fastening of the trunk is achieved by very simple means, especially if this creates a force component directed toward the foot-piece.

Directing the gripping force of the said claws on the trunk in such a way as to have a component of force in the direction of the foot-piece of the stand, is especially advantageous.

It is particularly desirable to form the fastening components and the holder out of one piece, suitably the fastening components and the holder are manufactured out of a pliable elastic material such as spring steel. This embodiment is particularly advantageous where there is provided a transitional area between the fastening components and the holder of increased elasticity for example by means of a deliberate weakening of the material in that area.

The following description of a completed version in reference to the illustration provides further details and advantages of the invention under consideration.

Figure 2:
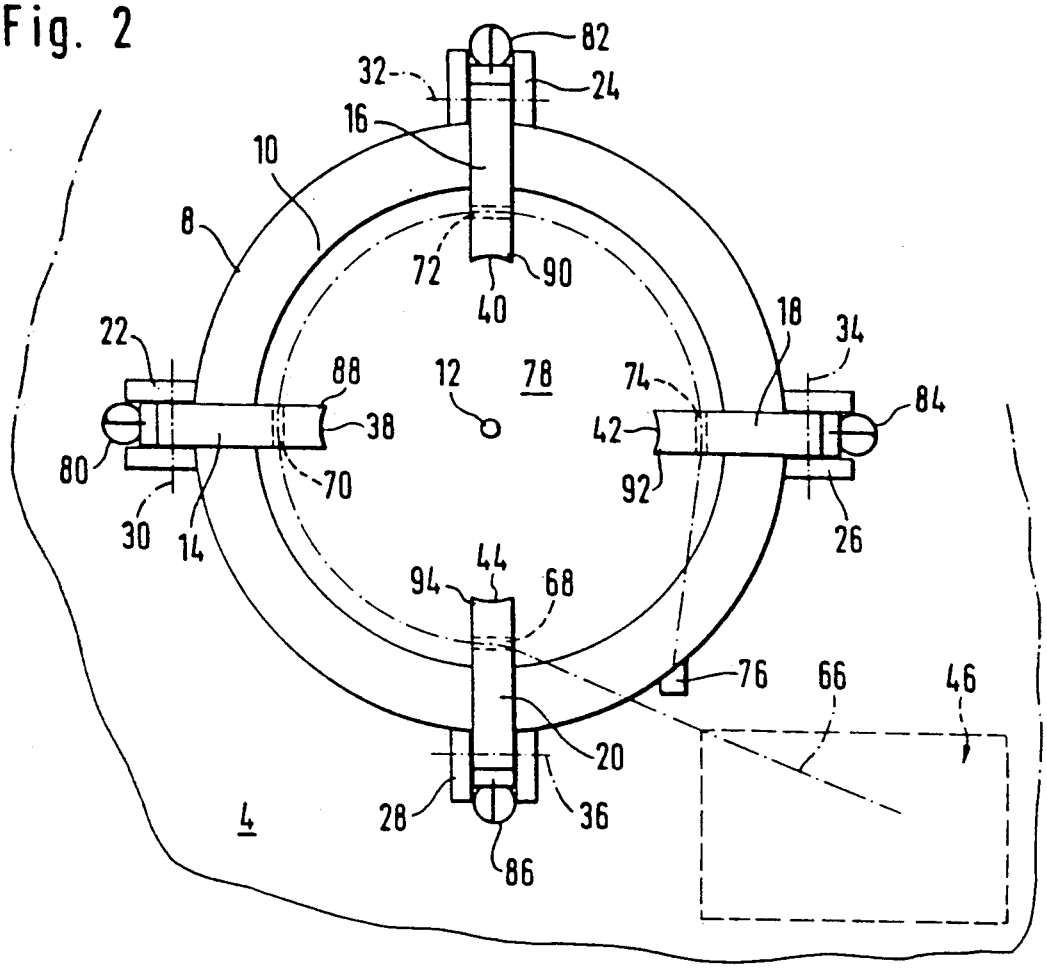
Figure 3:
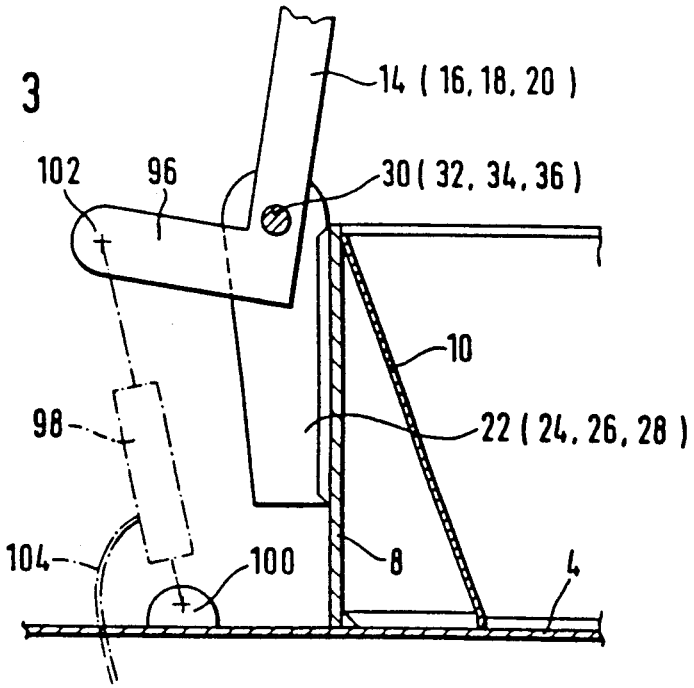
Figure 4:
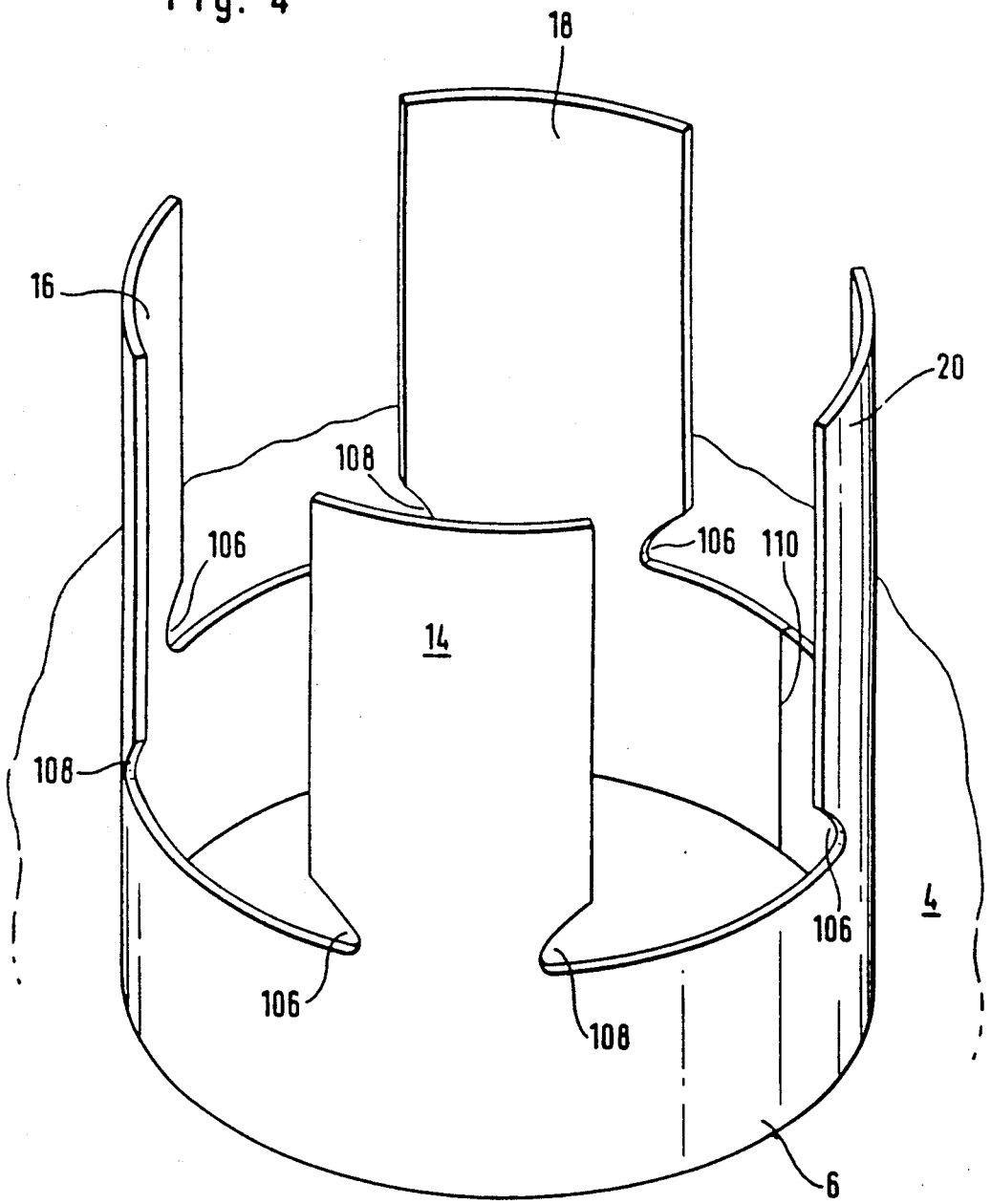

The illustrations show:

FIG. 1 a partially sideways cross-section of a completed version of the invention in question, in a highly simplified diagram;

FIG. 2 a top view of the completed version, in a highly simplified diagram;

FIG. 3 a variation of the completed version according to FIG. 1;

FIG. 4 a second completed version of the invention in question.

In FIG. 1, the Christmas-tree stand, generally designated as 2, mainly features a foot-piece 4 (for example a massive metal plate, triangular stand or the like) and a holder 6 affixed on it, which serves to hold a tree trunk (not pictured). The holder 6 consists mainly of a circular cylinder 8 with sides perpendicular to foot-piece 4 and a coaxial holding cone 10 inside it. The sides of holding cone 10 are slanted so that it widens from foot-piece 4 up to the edge of cylinder 8, as depicted in FIG. 1. A centering spike 12 is arranged concentrically within holding cone 10, pointing straight up. As FIG. 2 illustrates, several fastening components 14, 16, 18 and 20 are provided on the outer circumference of holder 6 and its cylinder 8. These fastening components 14, 16, 18 and 20 can pivot in bearing supports 22, 24, 26 and 28, being attached to the outer circumference of cylinder 8 by means of pivot axles 30, 32, 34 and 36. At the opposite ends of fastening components 14, 16, 18 and 20 are the butt-ends 38, 40, 42, and 44, which are applied to the tree trunk as explained below. Fastening components 14, 16, 18 and 20 swing between an open position, in which the tree can freely be inserted into, or removed from, holding cone 10, and a fastened position, in which butt-ends 38, 40, 42 and 44 hold the trunk in place between them.

Clamping device 46 is provided in order to move fastening components 14, 16, 18 and 20 from the open position into the fastened position by means of power transmission component 48. In the example of a completed version in FIG. 1, clamping device 46 features a standard ratchet mechanism 50 attached to foot-piece 4 as well as cylinder 8 by means of cross-pieces 52 and 54. Ratchet bar 56 turns winding roller 60, which is equipped with a pawl lock 58. A tension spring 62 pulls ratchet bar 56 towards cylinder 8 and its neutral position. Pawl lock 58 can be released by release bar 64 to let roller 60 turn freely. The design and operation of clamping device 46 in form of ratchet mechanism 50 is generally well-known. In the completed version in FIGS. 1 and 2, the power transmission component 48 is a steel cable 66, which is attached to roller 60 as shown in FIG. 1, and can be wound up onto it. Steel cable 66 runs from the roller through drilled holes of appropriate size 68, 70, 72, 74 in fastening components 14, 16, 18 and 20, as FIG. 2 illustrates. After cable 66 has passed through hole 74 in fastening component 18, its remaining loose end is appropriately fastened either to foot-piece 4 or in the area of holder 6. This can be done with a cable lock 74 or some equivalent device.

As the top view in FIG. 2 illustrates, cable 66, which serves as power transmission component 48, runs from clamping device 46, encircling about 75% of the insertion hole 78 around the fastening components 14, 16, 18 and 20, and traversing these components through drilled holes 68, 70, 72 and 74.

As long as cable 66 is loose, that is, as long as it is not pulled taut by clamping device 46, fastening components 14, 16, 18 and 20 are pulled back in the direction of their open position by release springs 80, 82, 84 and 86.

The operation of the invented Christmas-tree stand as described so far is as follows:

The bare end of the Christmas-tree to be mounted in the stand is inserted into insertion hole 78 between the butt-ends 38, 40, 42 and 44 of fastening components 14, 16, 18 and 20 in FIG. 1 downwards into holding cone 10 of cylinder 8 and holder 6. The centering spike 12 then provides an initial temporary horizontal positioning of the trunk. The entire tree is then brought into a vertical position by hand, whereupon the person holding the tree operates ratchet bar 56. This operation causes roller 60 to turn, progressively winding cable 66 onto the roller and thus stretching the cable. Ratchet bar 56 can conveniently be operated by foot by the person holding the tree up vertically. As cable 66, which is functioning as power transmission component 48, is wound onto roller 60 by the operation of ratchet bar 56 of clamping device 46, with the loose end of cable 66 being attached to cable lock 76, the tension building in cable 66 as well the decreasing length of the cable cause a general motion of the fastening components 14, 16, 18 and 20 toward the symmetrical axis running vertically through centering spike 12. Against the pull of the release springs 80, 82, 84 and 86, the progressively shortening cable 66 draws fastening components 14, 16, 18 and 20 inward. Fastening components 14, 16, 18 and 20 turn in pivot axles 30, 32, 34 and 36, causing the butt-ends 38, 40, 42 and 44 to progressively approach the surface of the tree trunk. Fastening components 14, 16, 18 and 20 pivot in planes that meet at the axis of symmetry, as shown in FIG. 2.

Since cable 66 passes through fastening components 14, 16, 18 and 20 in the various drilled holes 68, 70, 72 and 74, the force of tension exerted by clamping device 46 is transferred to all the fastening components 14, 16, 18 and 20 at the same time and distributed fairly equally. This brings the substantial advantage explained below:

In the following, let us assume that the butt-end 38 of fastening component 14 in FIG. 2 touches the surface of the inserted trunk first, owing to an irregular bulge in the trunk in the area of fastening component 14. As the clamping device is operated further, roller 60 continues to wind up cable 66 and the corresponding tension is transmitted over cable 66. However, fastening component 14 exerts no force on the tree trunk through butt-end 38, because cable 66 can run through drilled hole 70 with virtually no friction. Thus, only the remaining fastening components 16, 18 and 20 are progressively moved into contact with the trunk surface. Whichever fastening component 14, 16, 18 or 20 reaches the surface of the tree first, it then stays at rest there until the other fastening components have reached the trunk surface, either all at once or one after the other. Only when all butt-ends 38, 40, 42 and 44 of the fastening components 14, 16, 18 and 20 are resting against the surface of the tree does the force exerted by clamping device 46 on cable 66 again act on all the fastening components 14, 16, 18 and 20. Then butt-ends 38, 40, 42 and 44 are pressed against the circumference of the trunk by the force of clamping device 46.

It goes without saying that an alternative arrangement to the one illustrated in FIGS. 1 and 2 is possible, in which cable 66 is connected to fastening components 14, 16, 18 and 20 at drilled holes 68, 70, 72 and 74 lying above pivot axles 30, 32, 34 and 36. The points of contact of cable 66 can also be situated in the area of fastening components 14, 16, 18 and 20 located below pivot axles 30, 32, 34 and 36. In this case, cable 66 could, for example, run through drilled holes or eyelets located in mounting supports in the areas between fastening components 14, 16, 18 and 20, at a greater radial distance from centering spike 12 than pivot axles 30, 32, 34 and 36. The mounting supports could be attached either directly to foot-piece 4 or to a cover connected to foot-piece 4. When cable 66 is pulled taut by the operation of clamping device 46, the segments of fastening components 14, 16, 18 and 20 lying below pivot axles 30, 32, 34 and 36 (which would preferably be longer than these segments as depicted in FIG. 1) is pulled outward. This causes the segments of fastening components 14, 16, 18 and 20 located above pivot axles 30, 32, 34 and 36 to swing inward, and the butt-ends 38, 40, 42 and 44 of fastening components 14, 16, 18 and 20 to connect with the tree trunk in the manner explained above.

The described alternative routing for cable 66, which serves as power transmission component 48, through the area of fastening components 14, 16, 18 and 20 located below pivot axles 30, 32, 34 and 36 gives the advantage of being able to cover the length of cable 66, clamping device 46 as well as fastening components 14, 16, 18 and 20 practically completely by means of a covering cap. Such a cap would preferably be symmetrical to the axes and have a concentric hole to allow insertion of the tree trunk.

As FIG. 1 illustrates, it is useful to equip the butt-ends 38, 40, 42 and 44 of fastening components 14, 16, 18 and 20 with sharpened claws in areas 88, 90, 92 and 94, which dig further into the tree after they have been brought into contact with the surface of the trunk and further force is applied to cable 66. This increases the force holding the tree. A particular advantage of a claw-shaped design for the butt-ends 38, 40, 42 and 44 is that part of the force generated in pulling cable 66 taut by means of ratchet bar 56 is exerted on the trunk in direction of foot-piece 4 of tree stand 2. Thus claws 88, 90, 92 and 94 press the trunk further into holder 6 and thus give it added stability.

It would also be possible to design butt-ends 38, 40, 42 and 44 not in claw-shape, but rather in the shape of flattened and possibly even cushioned contact pads. This design is preferable especially when injury of the fastened tree is to be avoided.

FIG. 3 shows a variation of the tree stand invention in the area of fastening component 14. Naturally this variation applies to the other fastening components 16, 18 and 20.

As illustrated in FIG. 3, the end of fastening component 14 on the opposite side of pivot axle 30 from butt-end 38 is elongated and features a lever section 96 at roughly a 90° angle to fastening component 14. A power transmission component is provided between the top of foot-piece 4 and the free end of lever section 96 in the form of pressure-cylinder 98, which rests on foot-piece 4 in bearing 100 on the cylinder side. The pistonrod of pressure-cylinder 98 is attached to lever section 96 by means of a bearing 102 as well. Furthermore, pressure line 104 is installed and connected in series to the pressure-cylinders 98 of the other fastening components 16, 18 and 20 as well. In the variation shown in FIG. 3. The individual pressure-cylinders 98 and the pressure line 104 connecting them together form power transmission component 48. A pressure pump (not pictured) serves as clamping device 46 for power transmission component 48. This allows a pressurized fluid, such as hydraulic oil, or pressurized air to be pumped into the individual pressure-cylinders via the pressure line 104. Thus fastening components 14, 16, 18 and 20 can execute their pivoting motions from the open position to the fastened position and back again.

In this case the pressure pump could be operated by hand or foot like an air pump, or could be an electrically driven pump, for example.

In a further variation of the tree stand invention, fastening components 14, 16, 18 and 20 are not separate components hinged to pivot on holder 6. Rather, the individual fastening components and the holder are formed of a piece. FIG. 4 depicts this second variation of the invention in diagrammatically simplified perspective.

As illustrated in FIG. 4, the cylindrical holder 6 is affixed to foot-piece 4 of the tree stand. Fastening components (four, in the example shown) 14, 16, 18 and 20 are formed of one piece on holder 6. The necessary mobility is achieved by forming the holder and the fastening components of elastic material, such as spring steel or possibly reinforced plastics. The individual fastening components, formed into spring-mounted clamps, can also be applied to the tree trunk by force of the power transmission component 48 (not pictured) and return to the open position due to their own resiliency when the force is removed again. The spring-loaded fastened position of fastening components 14, 16, 18 and 20 can be improved, and their spring-action return to open position facilitated, if measures are taken in the manufacture to weaken the material in the transitional area between the fastening components and the holder, for instance by cutting notches 106 and 108 into each such area.

In this variation, holder 6 and the fastening components 14, 16, 18 and 20 formed from it can very easily be cut of some flat material in a single step. The cut-out then simply has to be bent into a cylinder and joined at the edges to form cylindrical holder 4 with its upward-protruding fastening components. The joint is made according to the material used. FIG. 4 depicts a butt-weld joint preserving the cylindrical shape of holder 6 after the flat cut-out has been bent. Aside from butt-weld 110, bolting together overlaping side portions of holder 6, heat welding, spot welding, glueing or similar methods would also be possible ways of joining the pieces.

In this variation, the necessary tightener (like cable 66, for example) is bent run through eyelets attached to, or formed out of, the backs of the fastening components.

The Christmas-tree stand invention 2 thus features the following attributes and advantages:

While fastening components 14, 16, 18 and 20 are being moved from open to fastened positions, whichever one first connects with the tree stays there, exerting virtually no force, until the remaining components have reached the trunk. Only then the tightening force of clamping device 46 is transmitted equally to all fastening components 14, 16, 18 and 20, causing butt-ends 38, 40, 42, and 44 to rest against the trunk, and grip claws 88, 90, 92 and 94 to dig into it. The fact that the force of tension that holds the tree is not exerted until after all fastening components 14, 16, 18 and 20 have made contact insures that the tree is not shifted out of its position in the course of being fastened into tree stand 2, even if the individual fastening components contact it irregularly and one after the other.

Chirstmas-tree stand invention 2 also makes it possible for a single person to set a Christmas-tree up vertically, as the tree must merely be inserted into holes 78, and stood up straight. It is then held in place by operating ratchet bar 56 of clamping device 46. This action pulls cable 66 taut and clamps the tree into stand 2. Complicated adjustments by individually turning clamps screws spread around the stand, or wedging the tree to achieve a vertical position are thus made unnecessary.

In the variation shown in FIG. 3, where the clamping device is a pressure pump, fastening the tree is even easier, because an electrically operated pump can then supply the individual pressure cylinders 98 with pressurized fluid and move the individual fastening components 14, 16, 18 and 20 into their fastened positions. If a mechanical pump is used, the best type would be a foot-operated one, so that the clamping process corresponds to operating ratchet bar 56 in the version shown in FIG. 1.

In any case, the progressive contact of fastening components 14, 16, 18 and 20 does not shift the trunk out of the position it was in before clamping device 46 was operated. Thus one can also fasten the trunk tightly and securely in a specific slanted position. This is especially useful if the surface under tree stand 2 is not horizontal, in the outdoors for instance, where a tree fastened straight up and down would actually turn out to be crooked.

To transfer the fastening components 14, 16, 18 and 20 of the version in FIG. 1 from the fastening to the open position, release bar 64 is operated to stop pawl lock 58 from acting on roller 60. Cable 66 relaxes due to its own elasticity, and no longer keeps fastening components 14, 16, 18 and 20 in their fastening position. Instead, the pull of release springs 80, 82, 84 and 86, or perhaps a little manual force, returns them to the open position, allowing the removal of the tree from the stand.

In the version depicted in FIG. 3, the pressure fluid is sucked out of the individual pressure cylinders 98, or escapes on its own on operation of a special value, letting fastening components 14, 16, 18 and 20 return their position as well.

Another substantial advantage of the Christams-tree stand invented is the fact that in version 1, shown in FIGS. 1 and 2, its variation shown in FIG. 3, as well as version 2 show in FIG. 4, the fastened position of fastening components 14, 16, 18 and 20 can be adjusted at any time. This is especially useful if the tree remains in tree stand 2 for a longer period of time, since the wood begins to dry out, the trunk shrinks, and the grip on the tree gradually weakens. In this case cable 66 can easily be tightened further by operating ratchet bar 56 once or twice, thus ensuring a secure grip by fastening components 14, 16, 18 and 20 again. In the case of the version in FIG. 3, the grip of fastening components 14, 16, 18 and 20 can be readjusted by a brief operation of the pressure pump.

Following variations are also conceivable in connection with this invention (explained briefly):

Naturally, the number of fastening components (four) depicted here is not binding. It would also be possible to install only three, or more than four such components evenly distributed around the circumference.

Designing clamping device 46 in the form of a ratchet mechanism is also only to be regarded as one example; other clamping devices for tightening cables 66 are conceivable as well. Electric motors could be installed, equipped with a suitable worm-gear and lock-catch to exert the tension on cable 66 necessary to operate the fastening components.

Instead of ratchet bar 56, or in addition to it, clamping device 46 can be equipped with a socket into which broomsticks and the like can be inserted to operate clamping device 46. This could be especially useful if the tree to be fastened is very expansive in its lower region, and access to ratchet bar 56 is thus restricted. Release bar 64 can also feature a useful kind of remote control, by means of a pulley or the like, for example. This would have the advantage that one does not have to crawl under the tree in order to open clamping device 46, especially because the tree is usually dry ands losing needles by the time it is to be removed.

The position that pressure cylinder 98 is installed in pictured in FIG. 3 is also only an example. Other positions, from which the force of pressure cylinder 98 could be applied to the fastening components, are also conceivable.

In the illustrations of FIGS. 1 and 2, cable 66 runs through drilled holes 68, 70, 72 and 74 in fastening components 14, 16, 18 and 20. Under certain circumstances, this could mean an unnecessary weakening of fastening components 14, 16, 18 and 20 by the drilled holes 68, 70, 72 and 74 in the area between the butt-ends 38, 40, 42 and 44 and the pivot axles 30, 32, 34 and 36. Therefore it may be advantageous to run cable 66 around rather than through fastening components 14, 16, 18 and 20, guided by eyelets welded onto the fastening components or some similar device.

The inventions described are not limited to fastening Christmas-trees. On the contrary, practically any approximately pole-shaped object can be fastened with the Christmas-tree stand invented. It can hold other decorative trees, sunshades, flagpoles, street signs etc. easily and securely.

The inside of holder 6 and cylinder 8 would best be of waterproof build, so that holding cone 10 or cylinder 8 can be filled with water and the tree in stand 2 stays fresh longer and does not dry out.

I claim:

1. Christmas-tree stand comprising:

one foot-piece;

a plurality of fastening components mounted on said foot-piece, said fastening components having a butt end and a pivotal end arranged symmetrically around a central axis, said components being swingable about a pivot axis proximal to said pivotal end, between an open and a fastening position in planes approximately intersecting at the central axis of symmetry, wherein the butt ends of the fastening components are pressable against a trunk of a tree; and a single clamping device acting on all of said fastening components simultaneously, said single clamping device including:

a power transmission component mounted on said foot-piece for moving the fastening components into their fastening position with adjustable gripping force, wherein said fastening components are initially applicable to the trunk by said power transmission component basically without force and independently of each other, whereby said gripping force does not act on the trunk until all fastening components have made contact.

2. Christmas-tree stand in accordance with claim 1, wherein said fastening components are swingable on pivot axles which all lie in the same plane, perpendicular to the axis of symmetry.

3. Chistmas-tree stand in accordance with claim 1, wherein the power transmission component is applicable upon each fastening component in an area between the butt-ends and the pivot axle.

4. Christmas-tree stand in accordance with claim 1, wherein the fact that the power transmission component is made of a tensile and flexible material.

5. Christmas-tree stand in accordance with claim 1, wherein the flexible material is a steel cable.

6. Christmas-tree stand in accordance with claim 1, wherein the clamping device is a locking ratchet mechanism.

7. Christmas-tree stand in accordance with claim 1, wherein the power transmission component is a pressure line having a pressure cylinder attachable thereto which act upon the fastening components.

8. Christmas-tree stand in accordance with claim 7, wherein the clamping device is a pressure pump.

9. Christmas-tree stand in accordance with claim 7, wherein the said pressure cylinders are attached to the said fastening components in an area on the side of the pivot axles distal from the butt-ends.

10. Christmas-tree stand in accordance with claim 1, wherein the said butt-ends are of claw shape, the trunk of the tree being penetrable by said claws by the force exerted by the clamping device through the power transmission component.

11. Christmas-tree stand in accordance with claim 10, wherein the gripping force of the said claws is exerted on the trunk in such a way as to have a component of force in the direction of the foot-piece of the stand.

12. Christmas-tree stand in accordance with claim 1, wherein the said fastening components and the holder are formed of one piece.

13. Christmas-tree stand in accordance with claim 12, wherein the fastening components and the holder are manufactured out of a pilable elastic material.

14. Christmas-tree stand in accordance with claim 13, wherein the elastic material is spring steel.

15. Christmas-tree stand in accordance with claim 13, having a transitional area between the fastening components and the holder of increased elasticity.

16. Christmas-tree stand accordance with claim 15, wherein said increased elasticity is achieved by means of a deliberate weakening of the material in that area.

* * * * *